US005299994A

United States Patent [19]

Chen

[11] Patent Number: 5,299,994

[45] Date of Patent: Apr. 5, 1994

[54] RETARDING DEVICE FOR AN EXERCISER

[76] Inventor: Ping Chen, No. 20, Nan-Mei St., Taichung City, Taiwan

[21] Appl. No.: 58,007

[22] Filed: May 3, 1993

[51] Int. Cl.[5] ..... A63B 22/04; A63B 21/012

[52] U.S. Cl. ..... 482/52; 482/114

[58] Field of Search ..... 482/114, 115, 118, 70, 482/116; 188/67

[56] References Cited

U.S. PATENT DOCUMENTS

| | | | |
|---|---|---|---|
| 1,707,791 | 4/1929 | Anderson | 482/114 |
| 3,768,808 | 10/1973 | Passera | 482/114 |
| 3,811,672 | 5/1974 | Simmons | 482/114 |
| 4,385,760 | 5/1983 | Mattox et al. | 482/114 |
| 4,641,832 | 2/1987 | Mattox | 482/114 |
| 4,826,152 | 5/1989 | Lo | 482/114 |

*Primary Examiner*—Stephen R. Crow

*Attorney, Agent, or Firm*—Ladas & Parry

[57] ABSTRACT

A retarding device for an exerciser includes a tubular housing, a drive shaft extending axially into the tubular housing and being movable axially therein, and a friction unit secured in the tubular housing and in contact with the drive shaft so as to resist axial movement of the drive shaft in the tubular housing. The tightness of contact between the friction unit and the drive shaft can be varied so as to vary correspondingly resistance to axial movement of the drive shaft.

3 Claims, 7 Drawing Sheets

RETARDING DEVICE FOR AN EXERCISER

BACKGROUND OF THE INVENTION

1. Field of the Invention

The invention relates to a retarding device for an exerciser, more particularly to a retarding device which can replace conventional hydraulic cylinders used in exercisers.

2. Description of the Related Art

Conventional exercisers usually incorporate a hydraulic cylinder unit to serve as a retarding device therefor. Referring to FIGS. 1 and 2, a conventional hydraulic stepper is shown to comprise an L-shaped frame (1) and two pedal units (2) hinged respectively on two sides of the frame (1). A hydraulic cylinder (3, 4) is provided on top of each of the pedal units (2). Each of the hydraulic cylinders (3, 4) has one end hinged to the frame (1) and a piston shaft (3*a*, 4*a*) connected to the respective pedal unit (2). A fluid path (6) interconnects the hydraulic cylinders (3, 4). When pressure is applied so as to move a first one of the pedal units (2) downward, the first one of the pedal units (2) pivots about a pin (la) on the frame (1), thereby pushing the piston shaft (3*a*) of the corresponding hydraulic cylinder (3) further into the cylinder body, as best illustrated in FIG. 2. Hydraulic oil (5) in the hydraulic cylinder (3) flows out of the latter and is transferred to the other hydraulic cylinder (4) via the fluid path (6). The piston shaft (4*a*) of the other hydraulic cylinder (4) is pushed downward, thereby causing a second one of the pedal units (2) to pivot upwardly. This illustrates how reciprocating movement of the pedal units (2) is achieved in the conventional hydraulic stepper.

The main drawbacks of using hydraulic cylinder units as the retarding device in an exerciser are as follows:

1. Leakage of hydraulic oil from the hydraulic cylinder units can easily occur, thus hindering the proper operation of the exerciser.

2. The hydraulic cylinder units are relatively expensive, thereby increasing the cost of the exerciser.

SUMMARY INVENTION

Therefore, the main object of the present invention is to provide a retarding device which is simple in construction and which can replace conventional hydraulic cylinders used in exercisers.

Another object of the present invention is to provide a retarding device which is relatively inexpensive and which can generate resistance so as to retard movement of the movable parts of an exerciser.

Accordingly, the retarding device of the present invention is to be installed in an exerciser and comprises a tubular housing, a drive shaft extending axially into the tubular housing and being movable axially therein, a friction unit secured in the tubular housing and in contact with the drive shaft so as to resist axial movement of the drive shaft in the tubular housing, and an adjustment means to vary tightness of contact between the friction unit and the drive shaft so as to vary correspondingly resistance to axial movement of the drive shaft.

The tubular housing has an inner wall surface that is formed with a plurality of axially extending and angularly spaced retaining grooves. The friction unit comprises a plurality of friction pieces, each of which being installed in a respective one of the retaining grooves and having a contact face and a rubber pad attached to the contact face.

In a preferred embodiment of this invention, the tubular housing has a plurality of radial outward projections, each of which corresponding to one of the retaining grooves and being formed with a threaded bore that is communicated with the corresponding one of the retaining grooves. The adjustment means comprises a plurality of adjustment pieces, each of which having a threaded shank which engages threadedly the threaded bore in a respective one of the outward projections such that a distal end of the threaded shank pushes a corresponding one of the friction pieces toward the drive shaft.

In another preferred embodiment of this invention, the tubular housing is formed with a plurality of radial openings, each of which corresponding to one of the retaining grooves. Each of the friction pieces has a rearward projection that extends through a respective one of the radial openings such that a distal end face of the rearward projection projects outwardly relative to an outer wall surface of the tubular housing. The adjustment means comprises a C-shaped clamping ring which has two spaced ends that are respectively formed with an outward flange and which is provided around the tubular housing such that an inner wall surface of the clamping ring presses against the friction pieces at the distal end face of the rearward projection thereof, and a screw fastener which extends between the outward flanges.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
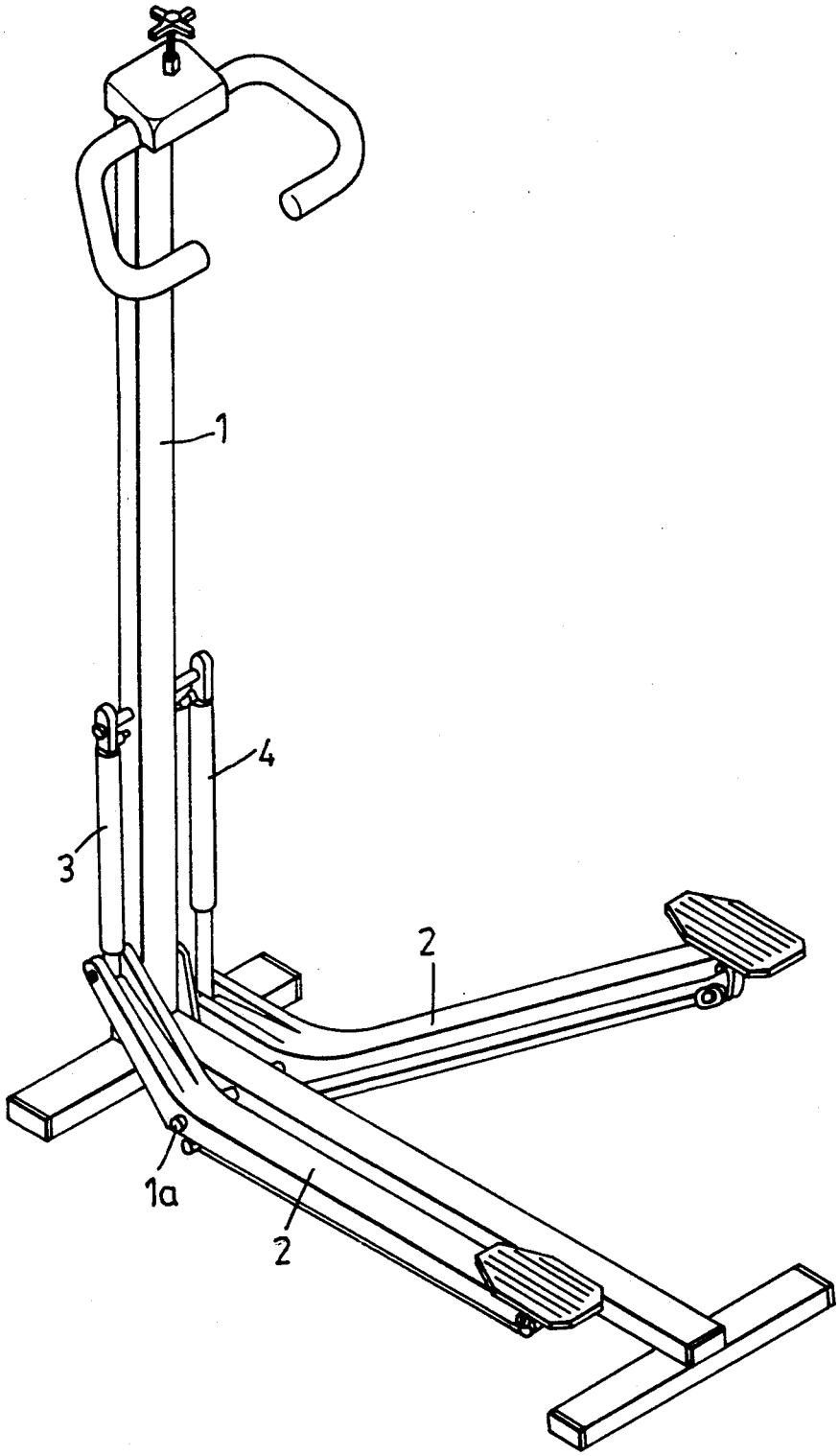
FIG.1 PRIOR ART
FIG. 1 is a perspective view of a conventional hydraulic stepper.
Figure 2:
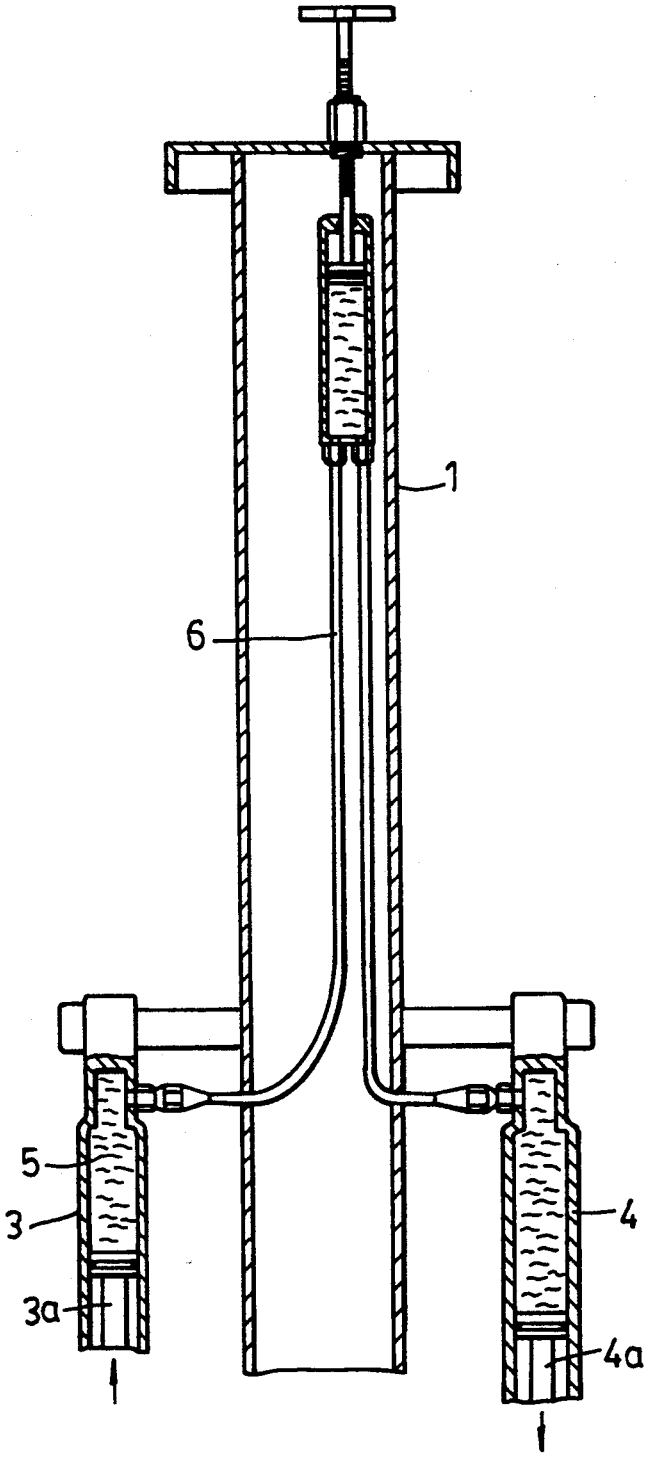
FIG.2 PRIOR ART
FIG. 2 is a fragmentary sectional view which illustrates the operation of the conventional hydraulic stepper shown in FIG. 1.
Figure 3:
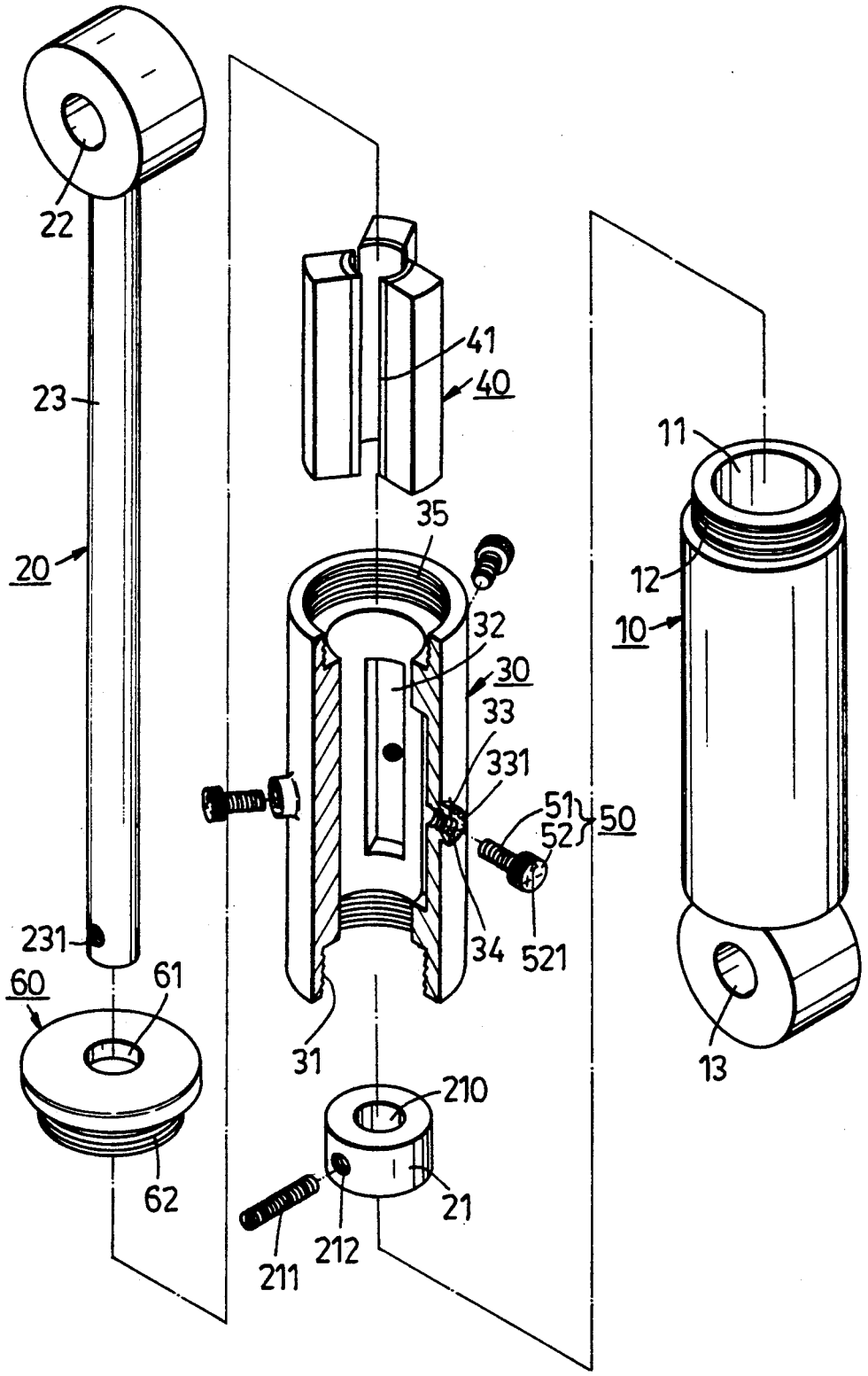
FIG. 3 is an exploded view of the first preferred embodiment of a retarding device according to the present invention.

Referring to FIG. 3, the first preferred embodiment of a retarding device according to the present invention is to be used in an exerciser and comprises a tubular housing with a mounting part (10) and a retaining part (30), a drive shaft (20), a friction unit which includes a plurality of friction pieces (40), an adjustment unit which includes a plurality of adjustment pieces (50), and a top cover (60).

The mounting part (10) confines a receiving space (11) and has an open top (12) that is threaded externally. The bottom of the mounting part (10) is formed with a coupling ring (13) so as to couple with an appropriate part of the exerciser (not shown).

The drive shaft (20) includes a thin cylindrical shaft (23) which has a lower end that is formed with a diametrically extending threaded hole (231). An enlarged cylindrical limit piece (21) is formed with an axial through hole (210) and a diametrically extending threaded hole (212). The lower end of the cylindrical shaft (23) extends into the through hole (210) of the limit piece (21) and is fastened thereto by means of a screw fastener (211) which engages threadedly the holes (212, 231). The cylindrical shaft (23) extends into the receiving space (11) and has a top end which is formed with a coupling ring (22) so as to couple with an appropriate part of the exerciser (not shown).

The retaining part (30) has a lower end (31) which is threaded internally so as to engage the open top (12) of the mounting part (10). The retaining part (30) has an inner wall surface that is formed with a plurality of axially extending and angularly spaced retaining grooves (32). In this embodiment, the retaining part (30) has three retaining grooves (32). The retaining part (30) further has a plurality of radial outward projections (33), each of which corresponding to one of the retaining grooves (32). Each of the outward projections (33) is formed with a threaded bore (34) that is communicated with the corresponding one of the retaining grooves (32) and has an outermost face that is provided with graduations (331). The retaining part (30) further has an upper end (35) that is threaded internally.

Each of the friction pieces (40) is formed as a longitudinal segment of an annular wall and is installed in a respective one of the retaining grooves (32). Each of the friction pieces (40) has a contact face and a rubber pad (41) attached adhesively to the contact face.

Each of the adjustment pieces (50) has a threaded shank (51) which engages threadedly the threaded bore (34) in a respective one of the outward projections (33) such that a distal end of the threaded shank (51) abuts a corresponding one of the friction pieces (40). Each of the adjustment pieces (50) further has a head portion (52) which is provided with markings (521).

The top cover (60) is formed with a central through hole (61) which permits the extension of the cylindrical shaft (23) therethrough, and has a lower part (62) which is threaded externally so as to engage the upper end (35) of the retaining part (30).

Assembly of the first preferred embodiment is as follows: After the top cover (60) has been engaged to the upper end (35) of the retaining part (30), the friction pieces (40) are installed respectively in the retaining grooves (32). The cylindrical shaft (23) of the drive shaft (20) is extended through the through hole (61) in the top cover (60) so as to be disposed between the friction pieces (40). The limit piece (21) is then fastened to the lower end of the cylindrical shaft (23) by means of the screw fastener (211). The lower end of the cylindrical shaft (23) is extended into the receiving space (11) of the mounting part (10), and the mounting part (10) and retaining part (30) are inter-engaged afterward. Finally, the threaded shanks (51) of the adjustment pieces (50) are engaged within the threaded bore (34) in the respective one of the outward projections (33).

Figure 5:
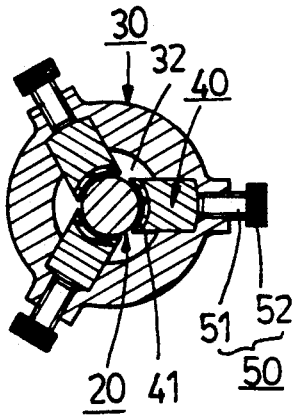
FIG. 5 is a V—V cross section of FIG. 4.
Figure 4:
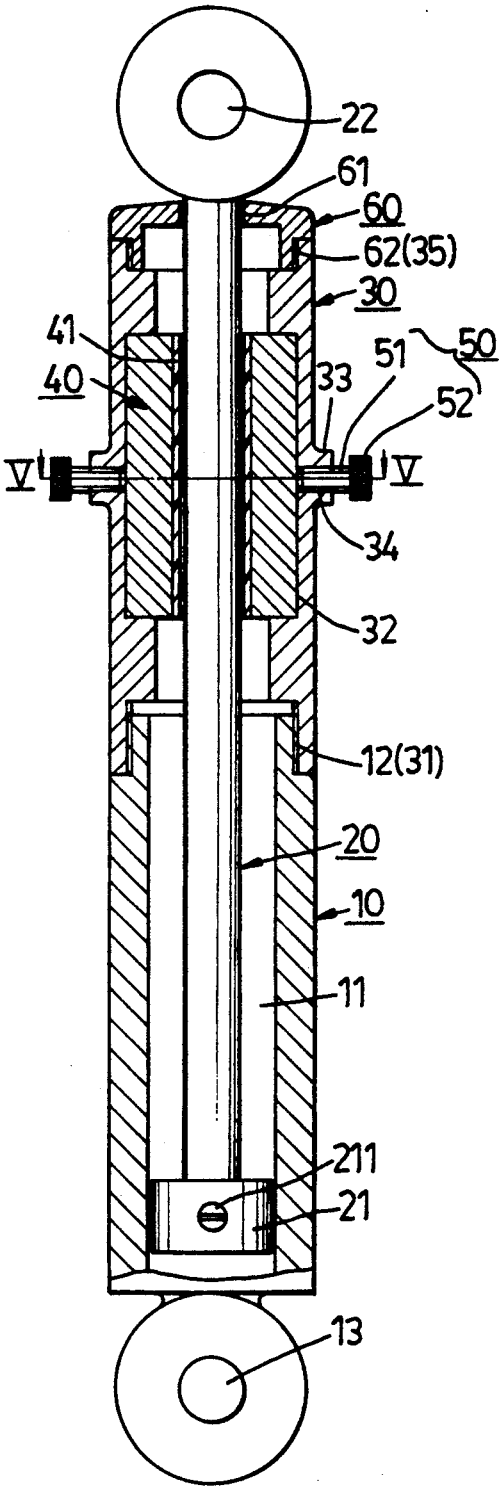
FIG. 4 is a sectional view of the first preferred embodiment.

Referring to FIGS. 4 and 5, when the rubber pads (41) of the friction pieces (40) are not in tight contact with the cylindrical shaft (23), the cylindrical shaft (23) moves axially within the tubular housing under the presence of minimal resistance. This facilitates initial positioning of the movable parts of the exerciser.

Figure 7:
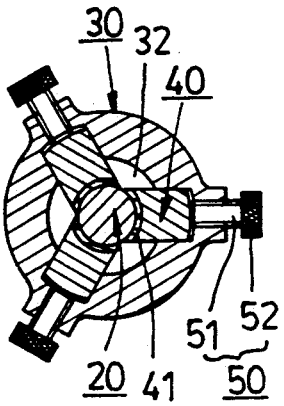
FIG. 7 is a VII—VII cross section of FIG. 6.
Figure 6:
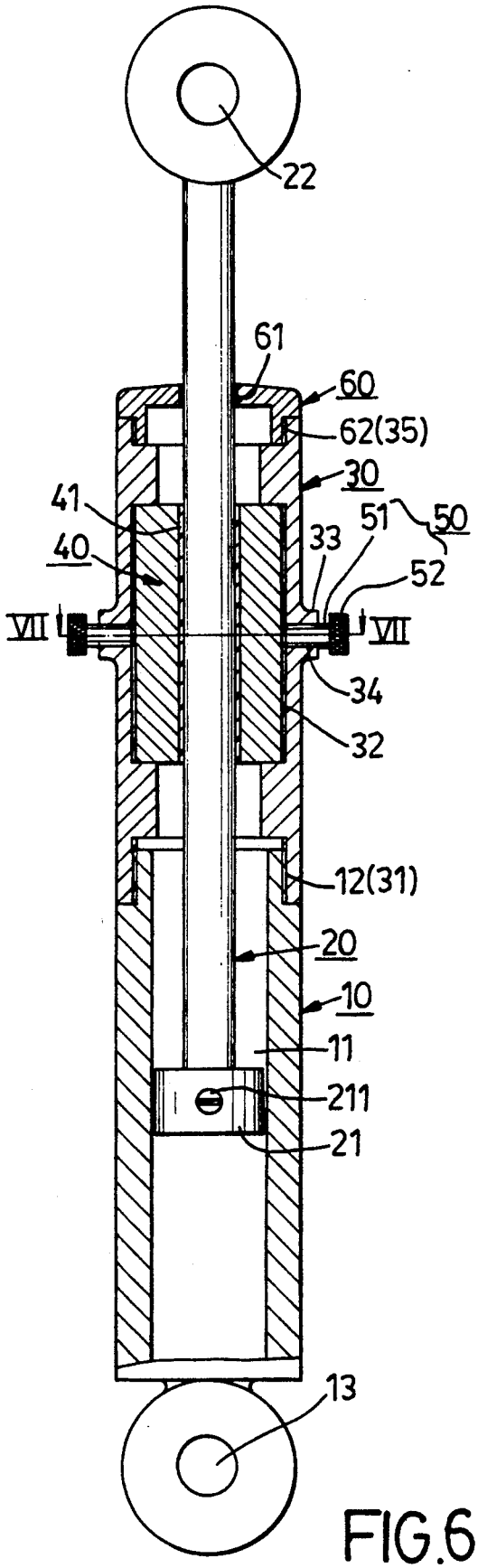
FIG. 6 is a sectional view illustrating the operation of the first preferred embodiment.

The resistance to be offered by the retarding device of the present invention should be adjusted so as to correspond with the body weight and the age of the user. Referring to FIGS. 6 and 7, in order to adjust the resistance of the retarding device, the adjustment pieces (50) are rotated so that the threaded shanks (51) of the former push the friction pieces (40) in a radial inward direction. The tightness of contact between the rubber pads (41) and the surface of the cylindrical shaft (23) is thus varied in order to vary correspondingly the resistance to axial movement of the drive shaft (20).

Figure 8:
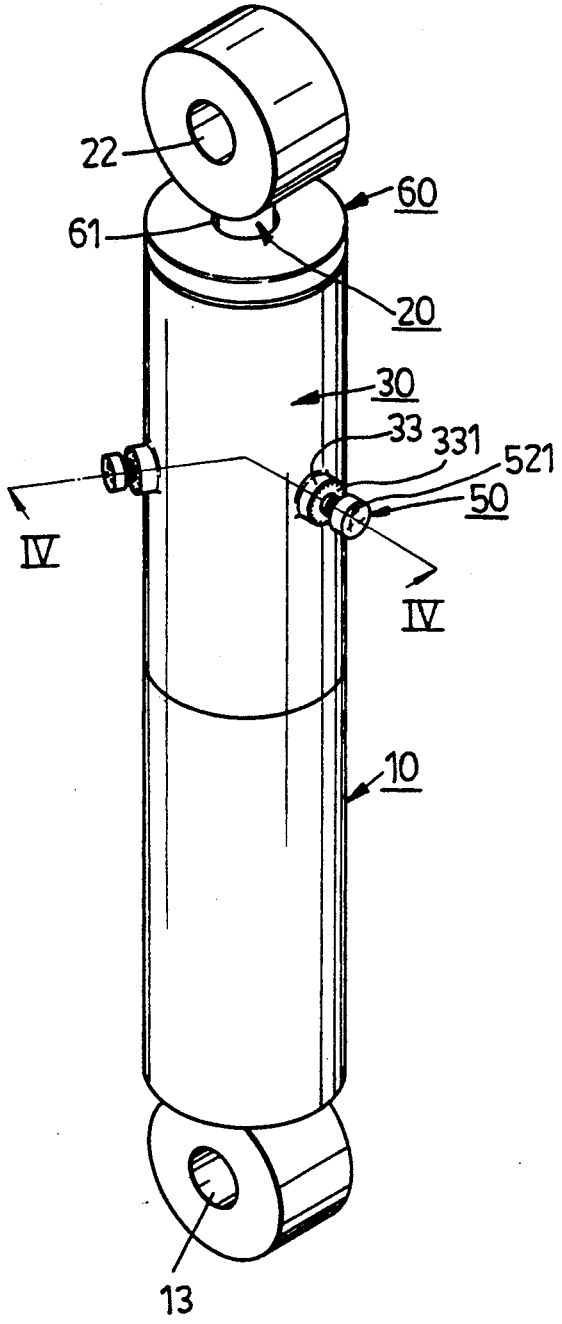
FIG. 8 is a perspective view of the first preferred embodiment.

Referring to FIG. 8, when adjusting the resistance of the retarding device, the markings (521) on the head portion (52) of the adjustment pieces (50) are made to correspond with the graduations (331) on the outward projections (33). This facilitates the adjustment of the retarding device so as to obtain the desired amount of resistance therefrom.

Figure 10:
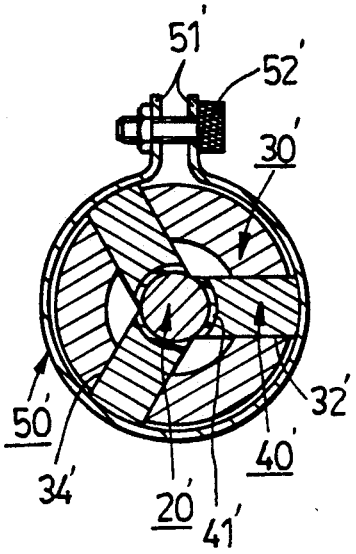
FIG. 10 is an X—X cross section of FIG. 9.
Figure 9:
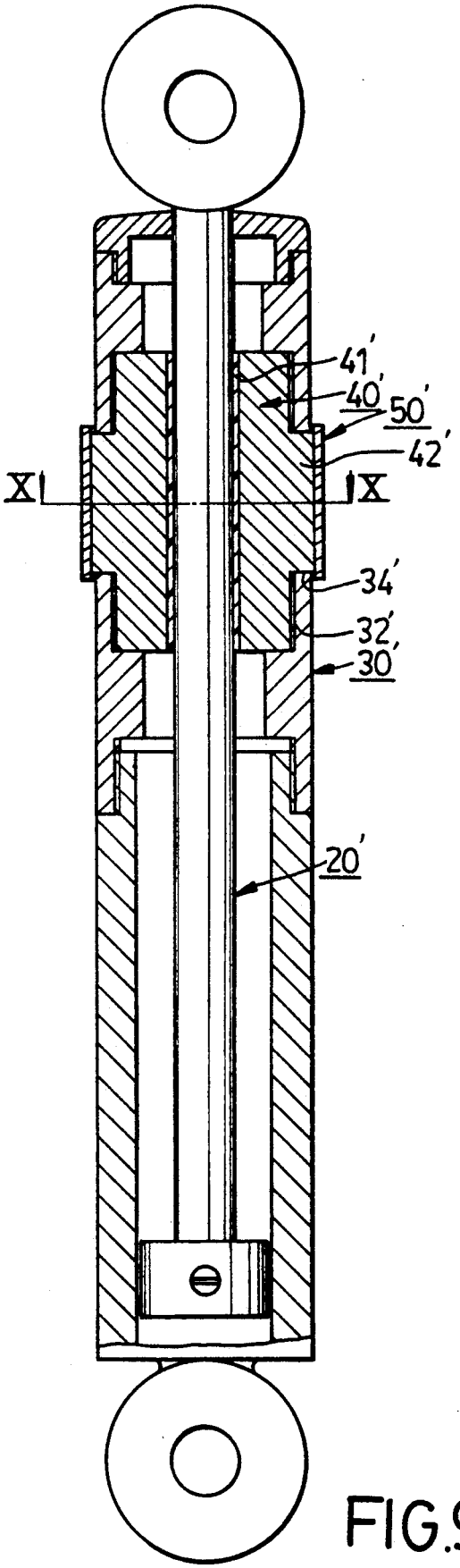
FIG. 9 is a sectional view of the second preferred embodiment of a retarding device according to the present invention.

The second preferred embodiment of a retarding device according to the present invention is shown in FIGS. 9 and 10. Instead of outward projections, the retaining part (30') is formed with a plurality of radial openings (34'), each of which corresponding to one of the retaining grooves (32'). Each of the friction pieces (40') is formed with a rearward projection (42') that extends through a respective one of the radial openings (34') such that a distal end of the rearward projection (42') projects outwardly relative to an outer wall surface of the retaining part (30'). In this embodiment, the adjustment unit is a C-shaped clamping ring (50') which has two spaced ends that are respectively formed with an outward flange (51'). A screw fastener (52') extends between the outward flanges (51'). The clamping ring (50') is provided around the retaining part (30') such that an inner wall surface of the clamping ring (50') presses against the friction pieces (40') at the distal end face of the rearward projection (42') of the latter.

When it is desired to vary the resistance offered by the retarding device of the second preferred embodiment, the screw fastener (52') is operated so as to narrow the space between the outward flanges (51'). The size of the clamping ring (50') is reduced, thereby causing the clamping ring (50') to push the rearward projections (42') into the radial openings (34'). The rubber pads (41') are pressed tightly toward the drive shaft (20'), thereby increasing the resistance provided by the retarding device. It has thus been shown that adjustment in the resistance offered by the retarding device is easy and convenient to accomplish.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A retarding device for an exerciser, comprising:

a tubular housing having an inner wall surface that is formed with a plurality of axially extending and angularly spaced retaining grooves, said tubular housing being formed with a plurality of radial openings, each of which corresponds to one of said retaining grooves;

a drive shaft extending axially into said tubular housing and being movable axially therein;

a friction unit secured in said tubular housing and in contact with said drive shaft so as to resist axial movement of said drive shaft in said tubular housing, said friction unit including a plurality of friction pieces, each of which is installed in a respective one of said retaining grooves and has a rearward projection that extends through a respective one of said radial openings such that a distal end face of said rearward projection projects outwardly relative to an outer wall surface of said tubular housing; and an adjustment means for altering tightness of contact between said friction unit and said drive shaft so as to vary correspondingly resistance to axial movement of said drive shaft, said adjustment means including a C-shaped clamping ring which has two spaced ends respectively formed with an outward flange and is provided around said tubular housing such that an inner wall surface of said clamping ring presses against said friction pieces at said distal end face of said rearward projection thereof and a screw fastener which extends between said outward flanges.

2. The retarding device as claimed in claim 1, wherein each of said friction pieces has a contact face and a rubber pad attached to said contact face.

3. The retarding device as claimed in claim 1, wherein said tubular housing has a plurality of radial outward projections, each of which corresponds to one of said retaining grooves and is formed with a threaded bore that is communicated with said corresponding one of said retaining grooves; and said adjustment means comprises a plurality of adjustment pieces, each of which has a threaded shank which engages threadedly said threaded bore in a respective one of said outward projections such that a distal end of said threaded shank pushes a corresponding one of said friction pieces toward said drive shaft.

* * * * *